US006829359B2

(12) United States Patent
Serrano

(10) Patent No.: US 6,829,359 B2
(45) Date of Patent: Dec. 7, 2004

(54) MULTISPEAKER SOUND IMAGING SYSTEM

(75) Inventor: Juan Serrano, Santiago de Chile (CL)

(73) Assignee: Arilg Electronics Co, LLC, Tampa, FL (US)

( * ) Notice: Subject to any disclaimer, the term of this patent is extended or adjusted under 35 U.S.C. 154(b) by 126 days.

(21) Appl. No.: 10/265,946

(22) Filed: Oct. 8, 2002

(65) Prior Publication Data

US 2004/0066937 A1 Apr. 8, 2004

(51) Int. Cl.[7] ..... H04R 5/00
(52) U.S. Cl. ..... 381/17; 381/18; 381/310
(58) Field of Search ..... 381/1, 17–23, 381/61, 63

(56) References Cited

U.S. PATENT DOCUMENTS 5,325,435 A * 6/1994 Date et al. ..... 381/1
5,412,732 A * 5/1995 Kanishi et al. ..... 381/18
5,524,053 A * 6/1996 Iwamatsu ..... 381/18
5,610,986 A 3/1997 Miles ..... 381/27
6,584,202 B1 * 6/2003 Montag et al. ..... 381/63

* cited by examiner

*Primary Examiner*—Xu Mei
(74) *Attorney, Agent, or Firm*—Albert Bordas; Jesus Sanchelima

(57) ABSTRACT

A sound imaging system, which by processing left and right stereo channel audio signals of a conventional two channel stereo system, distributes signals to a speaker array of a number of speakers determined by a listening area. Listeners located in different places within the listening area, can have an audible perception of an equivalent distribution to that of the conventional two channel stereo system. Additionally they will have an audible central perception of the centered program material equivalent to that obtained from the conventional two channel stereo system when the listeners are located in a median plane of the conventional two channel stereo system speakers.

14 Claims, 8 Drawing Sheets

MULTISPEAKER SOUND IMAGING SYSTEM

BACKGROUND OF THE INVENTION

1. Field of the Invention

The present invention relates to a multi-speaker sound imaging system, and more particularly, to an audio system that generates multi-channel imaging from two-channel recording, for improved user listening.

2. Description of the Related Art

Typically, musical systems for recording, storing and reproduction are made utilizing a two-channel system. The two-channel recording system basically works by mixing multiple instrument, voice, effects, and other sound signals, all of which produce as a resultant two signals or channels, which in turn are recorded in different media as CDs, tapes, etc. Additionally, two-channel amplifiers drive loudspeakers to reproduce these signals for listening.

The mixing process during two-channel recording is very important because the relative spatial positioning of all music components such as instruments, vocals, and all other sound signals, will be defined in this process. One objective of stereo reproduction is to permit the listener to perceive the original spatial distribution of the different sounds involved in the recording. Present musical systems work optimally only if the listener is in perfect geometrical and acoustical symmetry with respect to the two reproducing channels. The use of headphones permits a good approach to optimal stereo listening.

The fact that stereo listening depends on the position of the listener with respect to the two reproducing channels, has hindered optimal stereo listening. This is especially true with sounds that are common to both channels, which in the majority of recordings, includes the vocalist or singer.

In sub-optimal conditions, existing stereo systems do not give the listener the sensation of being in front of a vocalist or singer, but a sensation that the voice is distributed in space, and not located in a fixed position. Under this condition, the listener looses one of the most important sensations derived from listening to recordings, to be in the presence or in front of the vocalist or singer.

Some designs for improving the image for stereo systems have been done in the past. None of them, however, include a multi-channel of four or more even number of channels as a reproduction technique for stereo signals.

The multi-channel imaging is done by an electronic circuit that generates four or more even number of separate channel output signals, derived from the processing of two-channel recordings. The resulting signals are fed to amplifiers, which drive speakers located at defined positions. This permits, in the listening area, the listeners to perceive an audible sensation of having the singer in front of them and allowing the remainder of the music signals to be distributed according to the original recording thus giving the spatial sensation.

Practical experimentation with different speaker arrays has determined the positions in which the objective of frontal hearing is reached. Results were found to be the geometric places where the listener is symmetrical to any two speakers of an array.

Applicant believes that an approach corresponds to U.S. Pat. No. 5,610,986 issued to Miles for Linear-Matrix Audio-Imaging System and Image Analyzer. Miles teaches an audio-imaging system including at least first and second input channels for receiving first and second channel audio input signals and at least first, second and third output signals which are produced as a combination of the first and second channel audio input signals and a parameter, which is applied to the first, second and third output signals in order to compensate for composition mixing of the program source. The parameter can be varied by the user or determined by a sound image analyzer circuit.

Other patents describing the closest subject matter provide for a number of more or less complicated features that fail to solve the problem in an efficient and economical way. No patents suggest the novel features of the present invention.

SUMMARY OF THE INVENTION

The present invention utilizes, in its basic form, a single row speaker array with an even number of four or more speakers, all of these driven by amplifiers, permitting a lateral distribution similar to that of the original stereo recording. For central positioned signals, that is, for signals from the singer and instruments located at the center of a recording, the present sound imaging system simultaneously reproduces them into each of its output channels. The reproduction of these signals will give, in the listening area, a sound distribution that will cause the listeners a sensation of having the singer in front of them, while perceiving the spatial distribution of the recording.

With the present invention, instead of having two speakers in front of the listeners there can be four, six, eight or more, evenly arranged, preferably in a linear form, when using a single row speaker array. In order to obtain the maximum benefits of the present invention, the speakers, as well as the amplifiers, should have complementing characteristics and be of the same types.

The sound imaging system can be used in homes, cars, theaters, cinemas, and other locations where there is a need of stereo recordings listening. An additional benefit to utilizing multiple speakers in wide or spacious places is that the sound will be better distributed in the area, with lower decibel level per speaker, making it safer for the hearing of individual listeners.

Additionally, the sound imaging system is compatible with all stereo recordings and stereo systems.

More specifically, the instant invention is a sound imaging system, which by processing left and right stereo channel audio signals of a conventional two channel stereo system, distributes signals to a speaker array of a number of speakers determined by a listening area, in which listeners located in different places within the listening area, can have an audible perception of an equivalent distribution to that of the conventional two channel stereo system. Additionally, the listeners have an audible central perception of the centred program material equivalent to that obtained from the conventional two channel stereo system when the listeners are located in a median plane of the conventional two channel stereo system speakers.

The instant invention comprises first and second input channels for receiving the left and right stereo channel audio signals, four or more even number of output channels delivering four or more even number of audio output signals respectively as a result of processing the left and right stereo channel audio signals. The four or more even number of audio output signals are a function of the left and right stereo channel audio signals, and an adjustable parameter.

The first and second input channels are configured to receive the left and right stereo channel audio signals from the conventional two channel stereo system. The four or more even number of output channels are configured to be connected to a same number of audio amplifiers in order to drive four or more even number of speakers set as the speaker array.

A method for determining the adjustable parameter is presented by making equal a first summing localization of a first audio image produced by two sound sources to a second summing localization of a second audio image produced by four or more sound sources, where for the two sound sources:

$$D_{ST} = \frac{S'_1 \cdot D'_1 + S'_2 \cdot D'_2}{S'_1 + S'_2}$$

in which S'1 is a first signal amplitude at a first distance D'1 from an origin, S'2 is a second signal amplitude at a second distance D'2 from the origin, the first summing localization of the first audio image is located at a distance DST from the origin, wherein S'1 and S'2 are signals of same frequency and phase, but different amplitude. For the four or more sound sources:

$$D_{MSI2N} = \frac{\sum_{j=1}^{2n} (D_j \cdot S_j)}{\sum_{j=1}^{2n} S_j}$$

in which Sj is the amplitude of the j source, j is any of 2*n* sources, 2*n* is the number of the four or more sound sources, Dj is the distance between the four or more sound sources and the origin, the second summing localization of the second audio image is located at a distance DMSI2N from the origin, wherein Sj are signals of same frequency and phase, but different amplitude.

The four or more even number of audio output signals that are amplified by the audio amplifiers, which in turn drive the speaker array, have a first output channel with a first signal of the type: S1=(L+C)+K·(L−R), a last output channel with a last signal of the type: S2*n*=(R+C)+K·(R−L), producing said four or more even number of audio output signals of the type: Sj=C+L·M−R·(M−1) as a result of multiple signal divisions between the first signal and the last signal, where 2*n* is a number of the four or more even number of audio output channels, j is any of 2*n* output channels with an integer value from 1 to 2*n*, (L+C) is the left stereo channel audio signal, (R+C) is the right stereo channel audio signal, C is a central program audio signal of the left and right stereo channel audio signals, (R−L) is a result of the difference of the left stereo channel audio signal from the right stereo channel audio signal, (L−R) is an inverted (R−L) signal, $$M = \frac{1}{2n-1}[K\{1 + 2(n-j)\} + 2n - j],$$

and K is the adjustable parameter.

The speaker array comprised by the four or more even number of speakers, is arranged in a horizontal pattern, with equal distances between contiguous speakers, and positioned in such a way that the conventional two channel stereo system speakers are replaced by the speaker array of the four or more even number of speakers.

The speaker array is located in such a position that, at a first predetermined distance in between a first speaker of the four or more even number of speakers and one-third of a total width of the speaker array taken from the left, is a left speaker equivalent position of the conventional two channel stereo system and that, at a second predetermined distance in between a most right speaker and one-third of the total width of the speaker array taken from the right, is a right speaker equivalent position of the conventional two channel stereo system. The speaker array is symmetrically positioned to the conventional two channel stereo system speakers equivalent locations.

A 2*n* even number of four or more speakers comprising the speaker array and a positioning of the speaker array with respect to the conventional two channel stereo system speakers within the first and second predetermined distances for the listening area, determine a value of the adjustable parameter, when making the second summing localization of the second audio image positioning generated by the speaker array equal to the first summing localization of the first audio image generated by the conventional two channel stereo system speakers. The adjustable parameter being adjustable by a user.

A listening area width will determine a selection of the 2*n* even number of four or more speakers.

The instant invention has a first adjustment means for the user, for adjusting a number of the four or more even number of output channels by means of electrical switch selectors. Additionally, the instant invention includes a second adjustment means for the user, for adjusting the adjustable parameter by means of a potentiometer.

The adjustable parameter is adjustable within a range of 0 and 1, and a value for the adjustable parameter is displayed.

The four or more even number of output channels are connected respectively with the amplifiers driving the 2*n* even number of four or more speakers. Each positioned in the speaker array, wherein the 2*n* even number of four or more speakers originate (4n−3) listener position lines within the listening area which are perpendicular to the speaker array.

The listening area of the sound imaging system has a width extension located in between a center point of two most left speakers and a center point of two most right speakers of the speaker array, which is a single row speaker array in the preferred embodiment.

A multiple number of the speaker arrays installed horizontally and connected in parallel by columns, are used when the extension of the depth of the listening area requirements so demand.

It is therefore a main objective of the present invention to provide a new reproduction technique for stereo music that basically consists in reproducing signals that are common to stereo channels, especially singers and vocalists, in such a way that they can be perceived as centered by different listeners, in a wider space than that available from a conventional stereo system, while maintaining the spatial distribution of the recording.

It is another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
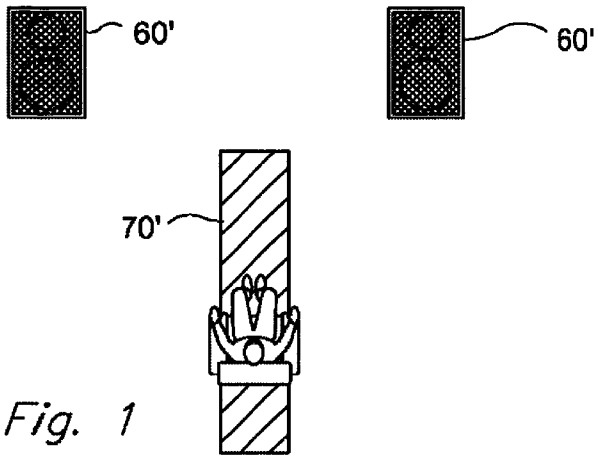
FIG. 1 represents the listening area for prior art stereo listening.

As seen in FIG. 1, a prior art conventional stereo has a relatively narrow listening area 70'. For optimal stereo listening, listeners must be situated at a distance exactly between both speakers 60' in this embodiment.

Figure 2:
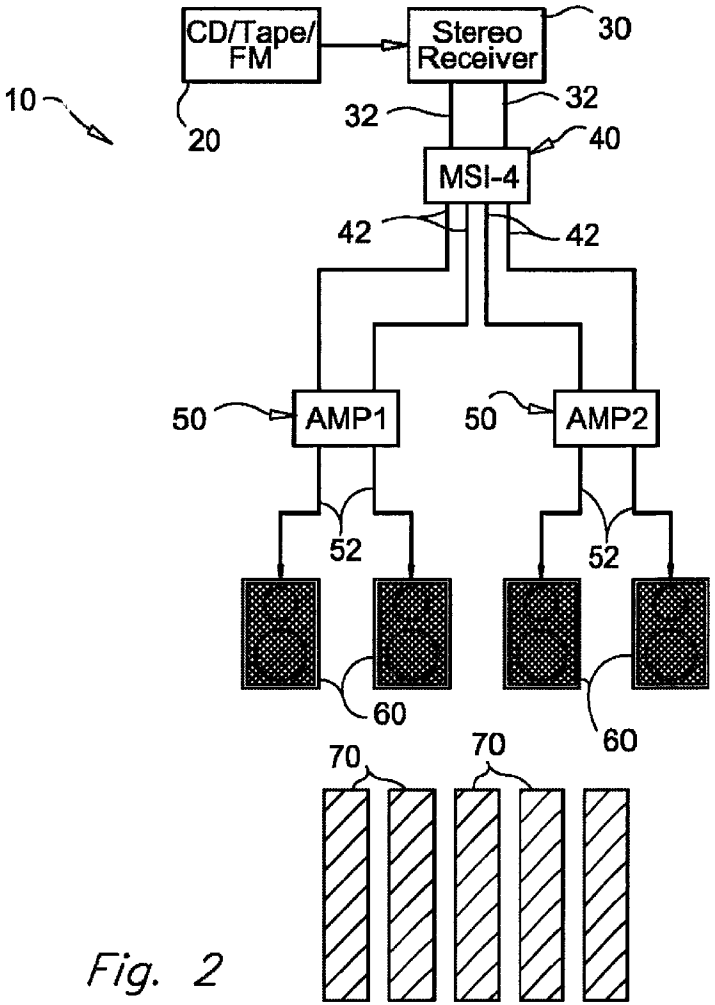
FIG. 2 is a block diagram of a four-speaker embodiment of the sound imaging system and the area defined for listening.

As seen in FIG. 2, the multi-speaker sound imaging system 10 is a sound processing system, defined as a multi-speaker imager 40 that is driven by a source 30 that handles two channel stereo FM signals and other sources of media 20. All further identifications of multi-speaker imager 40 are defined as "MSI". The MSI 40, seen in FIGS. 3*a* and 3*b*, illuminates light source 44 when powered. MSI 40 takes signals from a conventional stereo source through conductors 32, processes them, and delivers output signals though conductors 42 in an even number of four or more. External dual channel or multichannel amplifiers 50 amplify these signals, in order to drive speakers 60 through conductors 52 when used with a single row speaker array, thus establishing listening area 70.

For simplification, a single row speaker array and dual channel amplifiers will be considered. There shall be "n" number of conventional two channel amplifiers 50 connected to "2n" speakers 60. The MSI 40 will be identified as MSI2*n* 40 for the case of 2*n* speakers or simply MSI4 40 or MSI8 40, for four speakers 60 or eight speakers 60 respectively.

Figure 4A:
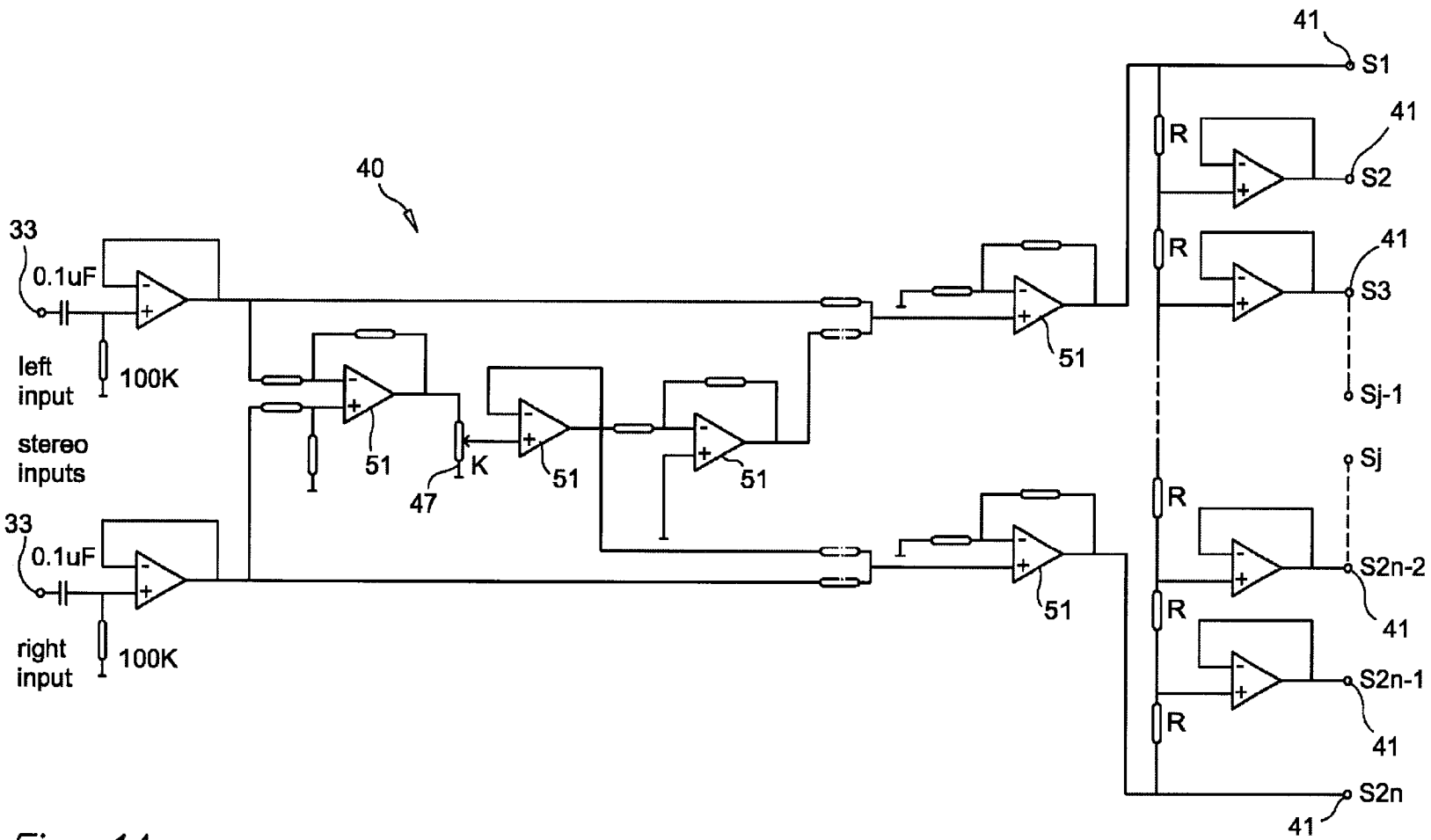
FIG. 4*a* represents an electrical schematic diagram of an embodiment of the instant invention.

There are several possibilities for the implementation of the electronic circuit in order to achieve the functionality of the MSI 40. An embodiment for a MSI2*n* 40 is seen in FIG. 4*a*, which shows operational amplifiers 51 and common components. To simplify the illustrated circuit, the power supply and other components, which do not affect its basic functionality, have been omitted.

Figure 3B:
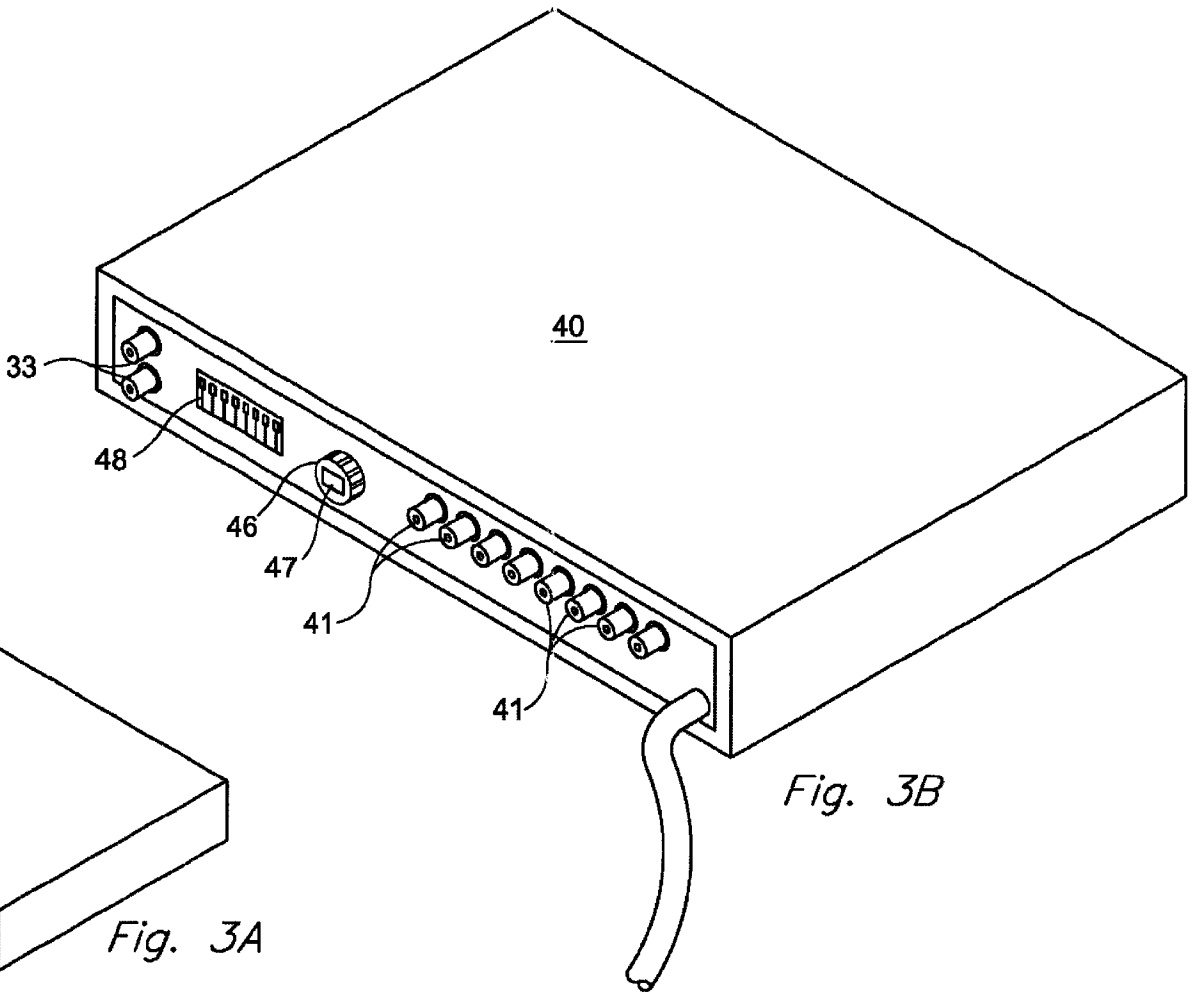
FIG. 3*b* is a rear perspective view of the MSI, selectable from MSI4 to MSI8.
Figure 3A:
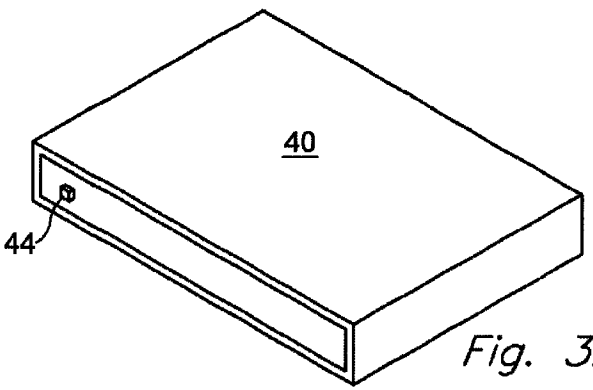
FIG. 3*a* is a front perspective view of the MSI.
Figure 4B:
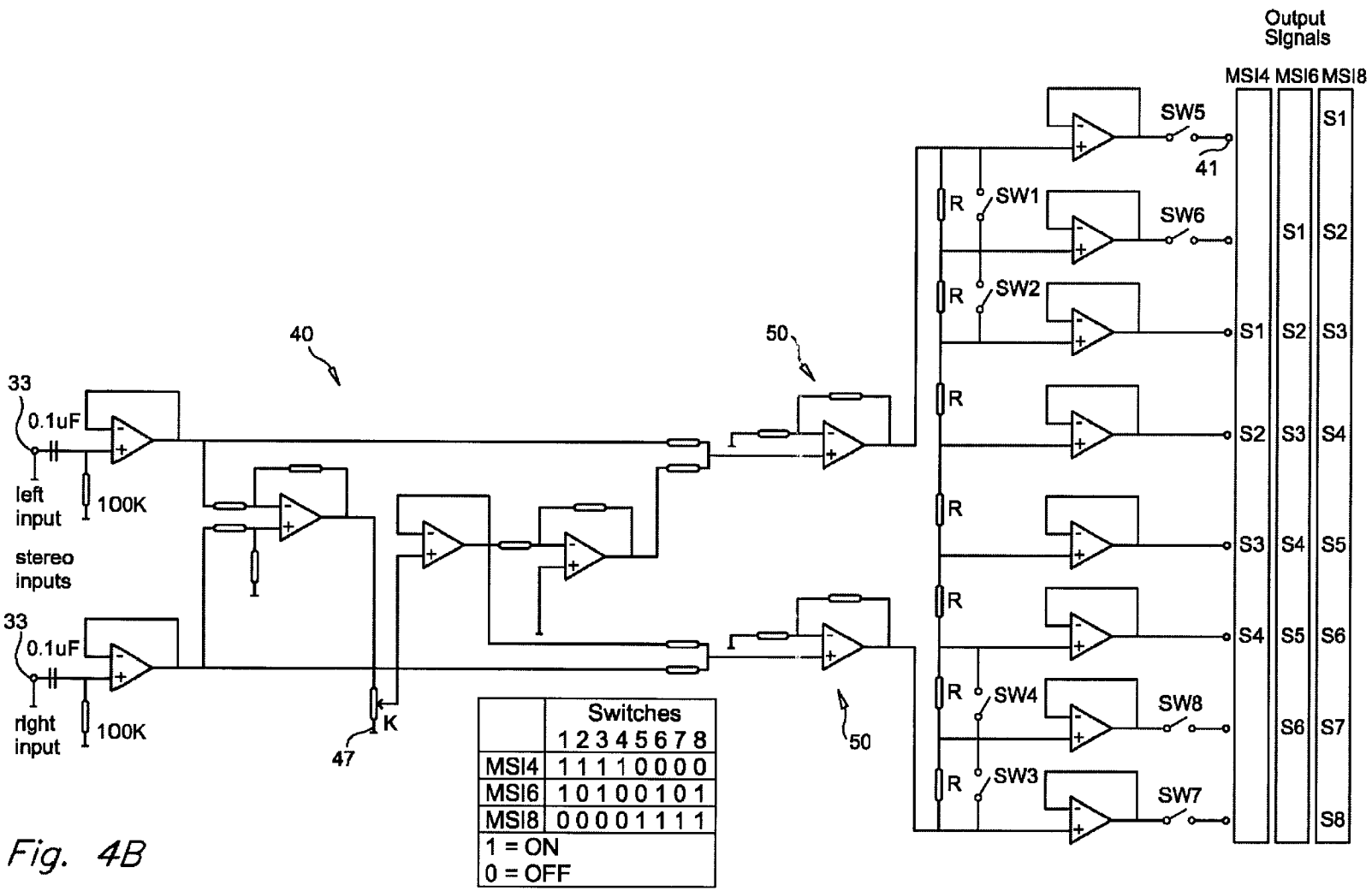
FIG. 4*b* represents an electrical schematic diagram of the MSI4 to MSI8 preferred embodiment of the instant invention.

In the preferred embodiment, seen in FIGS. 3*b* and 4*b*, potentiometer 47 with potentiometer dial 46 allows adjustment of a "K" parameter, and switch 48 is used to select the number of speakers that a user will choose, being these 4, 6, or 8. Potentiometer 47 may be a "BOURNS" 3610—precision potentiometer manufactured by Bourns Inc., in Riverside, Calif., or an equivalent potentiometer. Switch 48 may be a "BOURNS" SND Series DIP Switch manufactured by Bourns Inc., in Riverside, Calif., or an equivalent switch.

In an alternative embodiment, the MSI is factory wired according to the number of desired output channels.

The parameters are:

| | |
|---|---|
| 2n = | Total number of the MSI output channels 41, seen in FIG. 4a |
| j = | any MSI output channel 41 |
| K = | adjustment parameter |

The K value will be determined for each case depending on the value of 2*n*.

Spatial Distribution Definition.

Figure 5:
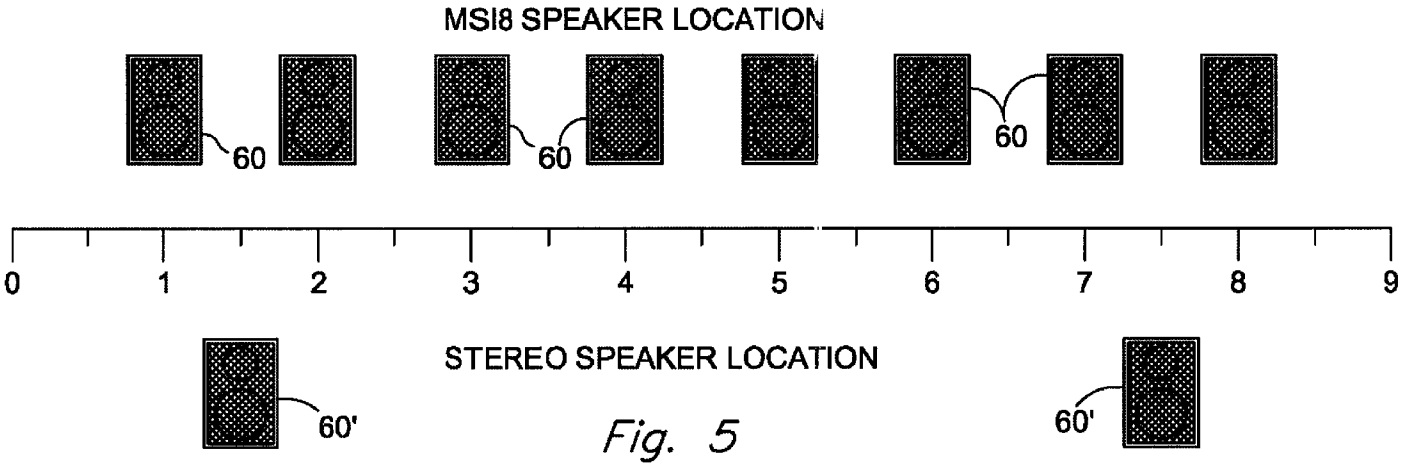
FIG. 5 illustrates the equivalent location of a conventional stereo pair of speakers relative to the location of the MSI speaker array for use with eight MSI speakers.

In order to maintain the closest distribution of stereo signals in listening area 70 of the MSI 40, the K parameter is determined according to the equivalent location of a conventional stereo pair of speakers 60', seen in FIG. 5, relative to the location of the speakers 60 of the MSI 40 speaker array.

K is calculated according to the following definition: the spatial position of two equivalent stereo system speakers 60' to the MSI2*n* 40, will be preferably located in a position point between each pair of speakers 60 of the right and left edges of the MSI 40 speaker array.

The position point is defined to be located:

i) at the center point between the first and second left speakers 60 of the MSI 40 speaker array location for the left stereo equivalent speaker 60', and in the center point between the two last speakers 60 to the right of the MSI 40 speaker array for the location of the right stereo equivalent speaker 60'; or ii) at a point located at a first predetermined distance between the first two speakers 60 of the MSI 40 speaker array for the left stereo equivalent speaker 60' and at a point located at a second predetermined distance between the two last speakers 60 to the right of the MSI 40 array, for the right stereo equivalent speaker 60'.

Figure 6:
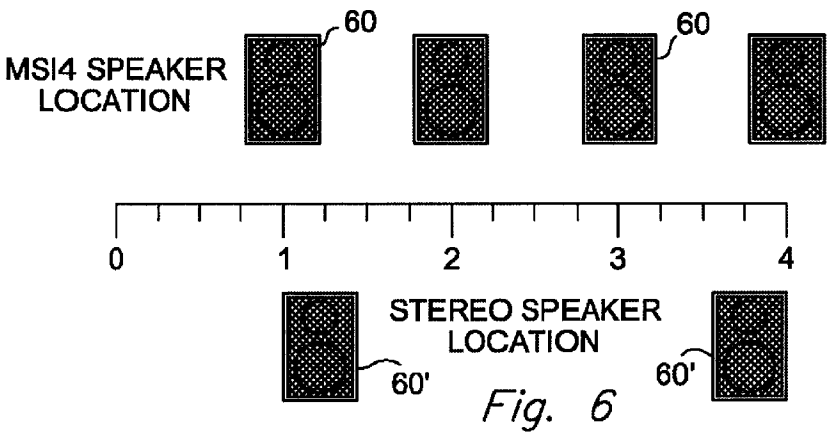
FIG. 6 illustrates the equivalent location of a conventional stereo pair of speakers relative to the location of the MSI speaker array for use with four MSI speakers.

To obtain a satisfactory listening area, option i) above is utilized for the MSI6 40 or more embodiment, as seen in FIG. 5; and option ii) above, for the MSI4 40, as seen in FIG. 6.

As an example in FIG. 5, if the MSI8 40 is being used, with 8 speakers 60 separated at a distance of 1 meter between each other, the total array has 7 meters of width. For calculation purposes, the origin will be located at 1 meter to the left of the first left speaker 60.

The K value will be calculated in a way that the equivalent stereo speakers 60' to the MSI 40 will be located at a position of 1.5 meters from the origin for the left stereo equivalent speaker 60', and at the 7.5 meter position for the right equivalent stereo speaker 60'.

The calculated value of K permits to obtain an equivalent position of a conventional equivalent stereo system. This is most important in order to produce, for the listener audience located in the listening area 70, seen in FIG. 2, an equivalent stereo distribution of sounds added to the reception of the central signals.

For the MSI4 40, the locations are illustrated in FIG. 6. The locations of the equivalent stereo speakers 60' has been defined to be 0.25 of the distance between speakers to the edge speakers 60, as shown.

Determination of K

We use basic concepts in order to calculate K.

First Concept—The location of a Sound image generated by two sources of same frequency, phase and different intensities.

The analogy used for this case will be that of the center of masses of a two mass distribution, being the distances to the origin the same as for the speakers and the masses; the masses will be replaced by the intensity of the S1 and S2 signals of speakers 60.

The image location for this case will be located at:

$$D_{ST} = \frac{S_1 D_1 + S_2 D_2}{S_1 + S_2} \tag{a}$$

where S1 is the signal at a distance "D1" from the origin, and S2 is the signal at a distance "D2" from the origin. "DST" will be the distance from the origin at which the image is located.

Figure 7:
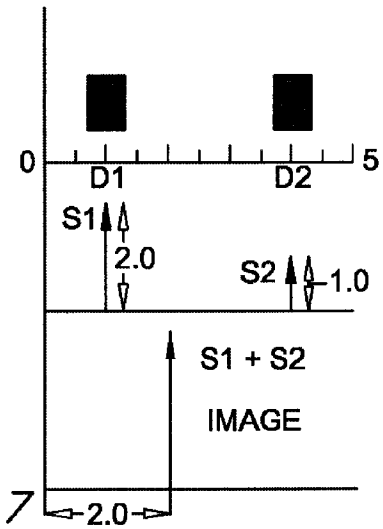
FIG. 7 illustrates the image position for two signals, S1 and S2, located at 1 meter and 4 meters from an origin and with intensities of 2 and 1 unit respectively, and the resultant image localization.

FIG. 7 illustrates the image position as an example, for two signals, S1 and S2, located at 1 meter and 4 meters from the origin and with intensities of 2 and 1 unit respectively.

When replacing S1=2, S2=1, D1=1 and D2=4 on $$D_{ST} = \frac{S_1 D_1 + S_2 D_2}{S_1 + S_2}$$

it is obtained that the image is at DST=2.0

Second Concept—The location of a sound image generated by multiple sources arranged in a linear array, which have signals of equal frequency and phase.

The analogy for the determination of the center of mass of a linear mass distribution is used to determine the image location of a linear distribution of signals.

The image for this case will be located at:

$$D_{MSI2N} = \frac{\sum_{j=1}^{2n} (D_j \cdot S_j)}{\sum_{j=1}^{2n} S_j} \tag{b}$$

in which:

2*n* will be the number of sources, being j any of these;

Dj is the distance between the Source j and the origin;

Sj is the signal present at the source j;

DMSI2N is the distance to the origin of the resulting image of the array. If the distance between each source is the unit, Dj can be replaced by j.

Additionally, as the MSI 40 introduces a 180-degree phase shift in some signals, they are taken into account with the resulting sign for the calculations: positive for zero phase shifts and negative for 180-degrees phase shift.

Figure 8:
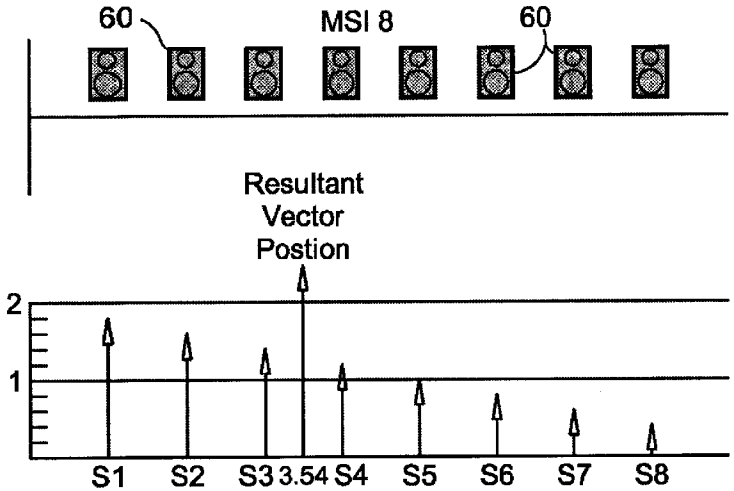
FIG. 8 is a representation of a MSI8 with signals S1 to S8, located at 1 meter of distance between each other and a resultant image localization.

FIG. 8 is a representation of a MSI8 40 with signals S1 to S8, located at 1 meter of distance between each other.

For the values of S1=1.8; S2=1.6; down to S8=0.4, the calculation of the position with (b) gives a result of an image location at 3.54 meters from the origin, being of no importance its magnitude in this example.

Relations on the MSI

Stereo channels have an "L" signal for the sounds to the left of the listening area, "R" for the right, and "C" as the common component or central signal, if it exists. The left signal has the form of (L+C) and the right signal has the form of (R+C).

As shown in FIG. 4*a*, the Si signal is delivered at the same time to a voltage divider of (2*n*−1) resistors, wherein the other end has the S2*n* signal.

Considering that from FIG. 4*a*, S1 and S2*n* signals are:

$$S_1 = (L+C) + K\cdot(L-R)$$

$$S_{2n} = (R+C) + K\cdot(R-L)$$

For channel "j", the "Sj" signal will be given by:

$$S_j = C + L\cdot M - R\cdot(M-1) \tag{c}$$

Where $$M = \frac{1}{2n-1}[K\{1+2(n-j)\} + 2n - j]$$

and wherein 2*n* is the number of output channels 41 and K the parameter to be determined.

It is observed that the central information C is present in all signals Sj of the MSI 40. This fact is relevant in order to generate the effect of central listening in the area.

If a stereo system is considered, utilizing formula (a) for the case of (L+C)=1 and (R+C)=0, by replacing S1=1 and S2=0, DST=1 is obtained. This means that the image position is on the same position of the left speaker.

In order to match the position of an equivalent MSI2*n* 40 to that of the conventional stereo considered previously, for the case of (L+C)=1 and (R+C)=0, considering i), the equivalent sound image of the MSI2*n* 40 system must be in the center point, between the two first left speakers.

This can be matched for any value of (L+C) and (R+C), but it is enough to calculate this with simple values like the ones selected (L+C)=1 and (R+C)=0, for the sound images will match at any value of (L+C) and (R+C) thereafter.

As seen in FIG. 5, the MSI8 40 is identified, where 2*n*=8. Using (c) above, the values for Sj, for the case of 2*n*=8 are:

$$S_1 = K + 1$$

$$S_2 = \frac{1}{7}(5K + 6)$$

$$S_3 = \frac{1}{7}(3K + 5)$$

$$S_4 = \frac{1}{7}(K + 4)$$

$$S_5 = \frac{1}{7}(3 - K)$$

$$S_6 = \frac{1}{7}(1 - 3K)$$

$$S_7 = \frac{1}{7}(1 - 5K)$$

$$S_8 = -K$$

For the eight speaker array, with speakers 60 separated at distances of 1 unit between them, being the first speaker 60 located at 1 unit distance from the origin, we shall determine K in order that the sound image generated is located at a distance of 1.5 units from the origin, in the center of the two first speakers 60.

Replacing these S1 to S8 values in formula (b) above and DMSI8=1.5, Dj=j and considering 2*n*=8:

$$D_{MSI8} = \frac{D_1 \cdot S_1 + D_2 \cdot S_2 + D_3 \cdot S_3 + D_4 \cdot S_4 + D_5 \cdot S_5 + D_6 \cdot S_6 + D_7 \cdot S_7 + D_8 \cdot S_8}{S_1 + S_2 + S_3 + S_4 + S_5 + S_6 + S_7 + S_8}$$

It's obtained that:

K=0.5

With the same method we calculate for several 2*n* output channels 41 and obtain:

| 2n | K |
|---|---|
| 6 | 0.357 |
| 8 | 0.5 |
| 10 | 0.591 |

This means that applying the definition i) above, a left only signal will give as result with the MSI 40 processing, of a sound image located in the center point of the first two left speakers 60.

K will be named the "Spatial Position Factor" and has a determined value for each 2*n* value of the MSI2*n* 40.

For the case of 2*n*=4, using ii) above, as seen in FIG. 6, it is obtained that for DMSI4=1.25; 2*n*=4 and Dj=j $$S_1 = K + 1$$

$$S_2 = \frac{1}{3}(K + 2)$$

$$S_3 = \frac{1}{3}(1 - K)$$

$$S_4 = -K$$

Replacing these values in (b) we obtain that:

K=0.25

With the K values obtained, the original stereo signals received by input channels 33, seen in FIG. 3*b*, will be distributed by the MSI 40 to the 2*n* output channels 41 of the MSI 40. The use of n dual amplifiers 50, seen in FIG. 2, with speakers 60 of the array, result in the sound images of both stereo and MSI systems to be coincident.

At the same time, the common signals present in the stereo channels will be distributed with equal intensity in all the MSI output channels 41, seen in FIG. 3*b*, consequently creating the conditions for central hearing in the listening area.

The definitions mentioned above are suggested locations for equivalent stereo speaker 60' positioned relative to the MSI 40 speaker 60 array for a satisfactory listening. The limits for these positions will be, for the left stereo speaker 60' equivalent position, from the location of the far left speaker 60 (first limit) of the array, to ⅓ of the total width of the array (second limit), taken from the left. The same will apply symmetrically to the right side. The K values for the first limit must be calculated for each 2*n* value and for the second limit, K has a value of zero.

MSI in Operation with a Single Row Speaker Array.

As seen previously, the MSI image distribution will be in coincidence with that of the original stereo, for the non-central signals.

For the central signals, the objective of MSI 40 is to permit that listeners in the listening area 70 perceive as front and centered signals those signals that are common to the original stereo channels. It is then of importance to determine how to install the speaker array relative to the positions of the listeners in order to obtain the mentioned effect.

The simultaneous arrival to both ears of the listener of signals, which are in phase and have the same amplitude, produces the sensation of a frontal hearing.

Figure 9:
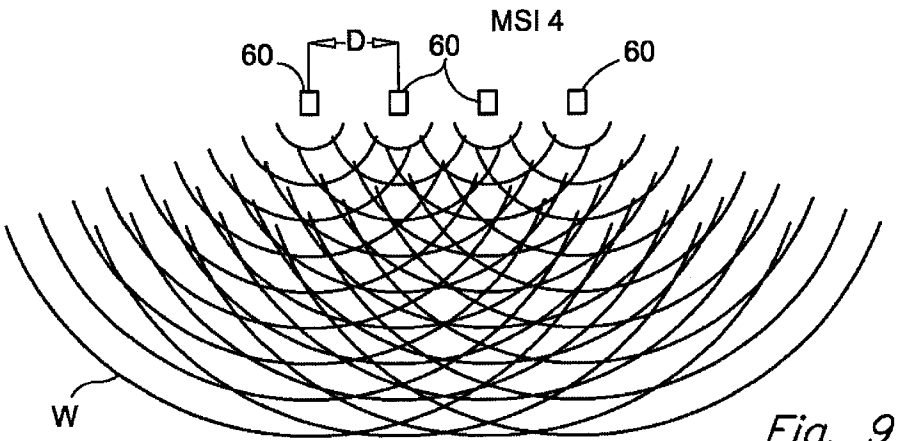
FIG. 9 represents wavefront patterns generated by a four speaker array, MSI4.

A wavefront W, seen in FIG. 9, is a surface in space at all points of which a sound vibration has the same phase.

For the present analysis, it will be considered that all speakers 60 are being driven by a single signal, to simulate the central information of the stereo channels.

Each speaker 60 generates spherical waves towards the front and these waves W will interact with other speaker waves W from the array. The wavefronts W generated by a four-speaker array, MSI4 40, will give wavefront W patterns as illustrated in FIG. 9.

The geometric interpretations of these patterns tend to be very complex when modifying the frequency, the speaker number and the speaker distances. Nevertheless, as shown, there are always points in which the listener can be located and receive at the same time identical wavefronts W from different speakers 60 that will give the listener the desired sensation.

These facts are the reason for the frontal sensation obtained by the listener when located at the center of any two speakers of the array as mentioned earlier. An additional result is that, for a listener located in front of the left or right edge speakers 60 of the array, the desired effect of central hearing is not obtained. This means that the two lateral speakers 60 to the listener determine the sense of direction, when the listener is located in front of a speaker 60.

Figure 10:
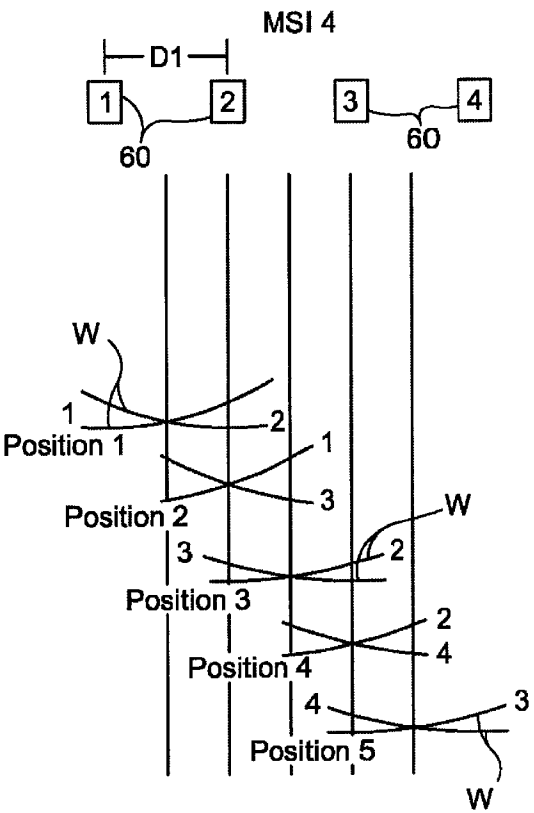
FIG. 10 represents different listener positions 1 to 5 and the wavefronts received by them from the MSI4.

As an example, FIG. 10 represents wavefronts W at different distances from a listener to the MSI4 array. In each vertical line there can be several listeners located. More specifically, FIG. 10 illustrates five different listener positions, at different distances of the array. In all cases, the perception of simultaneous wavefronts W in both ears gives the perception of the direction as frontal or coming from an array. Positions 1, 3 and 5 are the case where there is no speaker 60 in front of the listener and the numbers indicated in each position corresponds to the number of the radiating speakers 60 from which the listener perceives the wavefronts.

At positions 2 and 4, the signals indicated are the ones that produce almost twice the intensity level (+3 dB) compared to the signals radiated by the front 2 and 3 speakers 60, giving the sensation of frontal hearing with similar signal intensity as the former case. So, for the different arrays, the number of lines for listener positions will be:

CHART 1

| ARRAY | Listener Position Lines |
|---|---|
| $MSI_4$ | 5 |
| $MSI_6$ | 9 |
| $MSI_8$ | 13 |
| $MSI_{10}$ | 17 |
| $MSI_{2n}$ | 4n − 3 |

Determination of Speaker Distances

Figure 11:
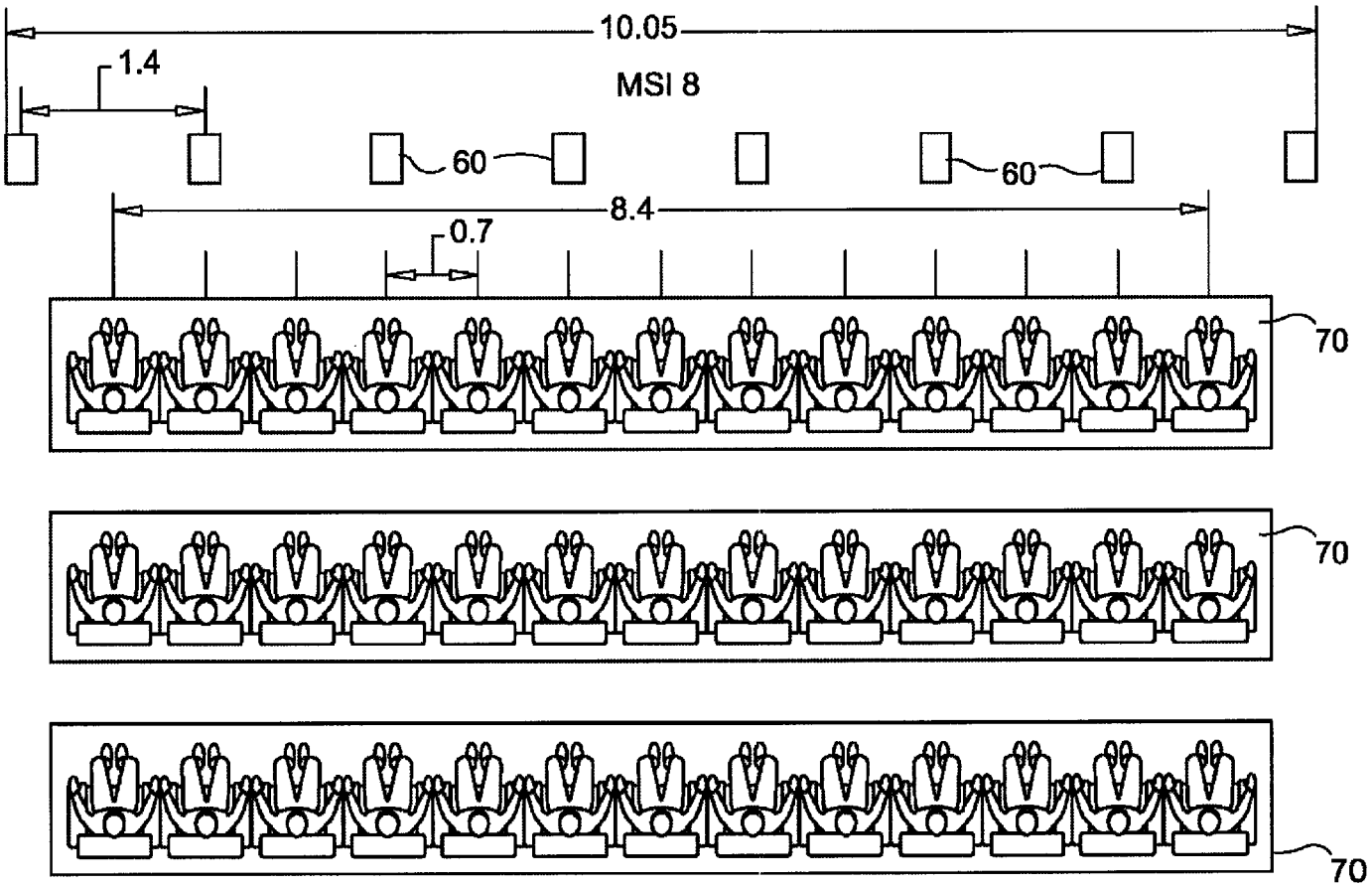
FIG. 11 illustrates an optimal seating configuration for an example of room size.

In order to obtain the optimal distance between speakers, the analysis will determine which are the possible positions of the listeners in the listening area 70, seen in FIG. 11.

The listening area 70 is defined as the area in which a listener can be located when a speaker array distributes the stereo sound that meets the imaging process as defined by the principles of the MSI2*n* 40. The area will have a width and a length. The listeners will be positioned facing the speaker array.

A general rule to follow in order to have good distribution in a small listening area 70 is to have a distance between speakers 60 between 0.5 meters and 1.0 meter, depending upon the area to cover. In a car, the speaker distances can be smaller.

For listeners sitting side by side in rows, as in a theater, positioning for speakers 60 can be calculated by assuming that a listener needs X cms laterally for his location. Then, if we have a listening area 70 of Z meters wide, the maximum number of listener rows will be Z/X and the number of listener position lines in the array should be determined by chart 1 above. It is observed that the room is wider than listening area 70, because the edge listener to the right is located centered to the first two speakers 60 of the right having the same situation on the left.

The minimum distance between speakers 60 will be D=2·X and the minimum space width for the speaker array installation W' will be:

W'=(2*n*−1)·D+D0; where D0 is the width of a single speaker 60.

As shown in FIG. 11, as an example there is a group of listeners sitting side to side in seats that cover a width of 0.7 meters each, and listening area 70 is 10 meters wide. The speaker width is 25 cms.

The maximum number of listening rows will be:

Z/X=10/0.7=14.28 or 13 rows for practical purposes.

With chart 1, the MSI8 40 meets the requirement.

The distance between speakers 60 is "D"=1.4 meters and the space width for speaker installation will be W'=10.05 meters, as shown.

The distances from the listeners to the array will be determined by the size of the room or the extension of listening area 70, being no limit for this magnitude but only in relation to sound intensities to be perceived.

In the case there is an area of large length to be covered by recorded music, several parallel arrays with a fixed distance between them can be installed, adjusting these distances according to the sound pressure levels to be present in the different listener positions. In the case the area has a ceiling, several parallel arrays can be installed in the ceiling, maintaining the side to side distribution with MSI 40.

Figure 12:
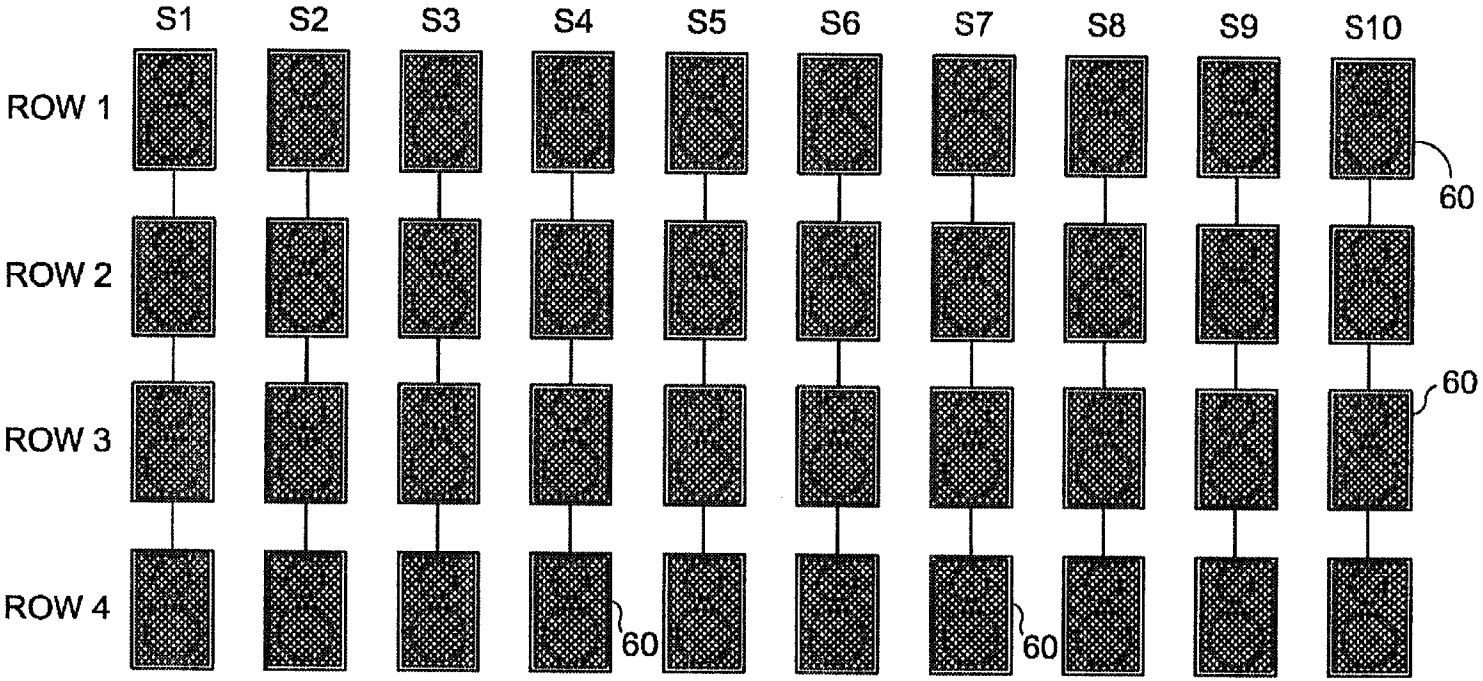
FIG. 12 represents an alternate embodiment for a multi row speaker array.

In an alternate embodiment, multiple speaker arrays located vertically, or in the ceiling, as shown in FIG. 12, may be arranged for large quantities of listeners, such as in gathering areas or in a theatre of significant height, for example. The horizontal or left to right distribution of sounds will be generated by the sound imaging system. The sound imaging system channel number to be used in each case will depend on the listening area to be covered, defining the distance between speakers 60.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sound imaging system, which by processing left and right stereo channel audio signals of a conventional two channel stereo system, distributes signals to a speaker array of a number of speakers determined by a listening area, in which listeners located in different places within said listening area, has audible perception of an equivalent distribution to that of said conventional two channel stereo system, additionally having an audible central perception of centred program material equivalent to that obtained from said conventional two channel stereo system, when said listeners are located in a median plane of the conventional two channel stereo system speakers further comprising first and second input channels for receiving said left and right stereo channel audio signals, four or more even number of output channels delivering four or more even number of audio output signals respectively as a result of processing said left and right stereo channel audio signals, wherein said four or more even number of audio output signals are a function of said left and right stereo channel audio signals, and an adjustable parameter, wherein said first and second input channels are configured to receive said left and right stereo channel audio signals from said conventional two channel stereo system and said four or more even number of output channels are configured to be connected to a same number of audio amplifiers in order to drive four or more even number of speakers set as said speaker array, and wherein a method for determining said adjustable parameter is presented by making equal a first summing localization of a first audio image produced by two sound sources to a second summing localization of a second audio image produced by four or more sound sources, where for said two sound sources:

$$D_{ST} = \frac{S'_1 \cdot D'_1 + S'_2 \cdot D'_2}{S'_1 + S'_2}$$

in which S'1 is a first signal amplitude at a first distance D'1 from an origin, S'2 is a second signal amplitude at a second distance D'2 from said origin, said first summing localization of said first audio image is located at a distance DST from said origin, wherein S'1 and S'2 are signals of same frequency and phase, but different amplitude; and for said four or more sound sources:

$$D_{MSI2N} = \frac{\sum_{j=1}^{2n} (D_j \cdot S_j)}{\sum_{j=1}^{2n} S_j}$$

in which Sj is the amplitude of the j source, j is any of 2*n* sources, 2*n* is the number of said four or more sound sources, Dj is the distance between said four or more sound sources and said origin, said second summing localization of said second audio image is located at a distance DMSI2N from said origin, wherein Sj are signals of same frequency and phase, but different amplitude.

2. The sound imaging system set forth in claim 1, wherein said four or more even number of audio output signals that are amplified by said audio amplifiers which in turn drive said speaker array, have a first output channel with a first signal of the type:

S1=(L+C)+K·(L−R), a last output channel with a last signal of the type: S2*n*=(R+C)+K·(R−L), producing said four or more even number of audio output signals of the type:

Sj=C+L·M−R·(M−1) as a result of multiple signal divisions between said first signal and said last signal, where 2*n* is a number of said four or more even number of audio output channels, j is any of 2*n* output channels with an integer value from 1 to 2*n*, (L+C) is said left stereo channel audio signal, (R+C) is said right stereo channel audio signal, C is a central program audio signal of said left and right stereo channel audio signals, (R−L) is a result of the difference of said left stereo channel audio signal from said right stereo channel audio signal, (L−R) is an inverted (R−L) signal, $$M = \frac{1}{2n-1}[K\{l + 2(n-j)\} + 2n - j],$$

and K is said adjustable parameter.

3. The sound imaging system set forth in claim 2, wherein said speaker array comprised by said four or more even number of speakers, is arranged in a horizontal pattern, with equal distances between contiguous speakers, and positioned in such a way that said conventional two channel stereo system speakers are replaced by said speaker array of said four or more even number of speakers.

4. The sound imaging system set forth in claim 3, wherein said speaker array is located in such a position that, at a first predetermined distance in between a first speaker of said four or more even number of speakers and one-third of a total width of said speaker array taken from the left, is a left speaker equivalent position of said conventional two channel stereo system and that, at a second predetermined distance in between a most right speaker and one-third of said total width of said speaker array taken from the right, is a right speaker equivalent position of said conventional two channel stereo system, said speaker array symmetrically positioned to said conventional two channel stereo system speakers equivalent locations.

5. The sound imaging system set forth in claim 4, wherein a 2*n* even number of four or more speakers comprising said speaker array and a positioning of said speaker array with respect to said conventional two channel stereo system speakers within said first and second predetermined distances for said listening area, determine a value of said adjustable parameter, when making said second summing localization of said second audio image positioning generated by said speaker array equal to said first summing localization of said first audio image generated by said conventional two channel stereo system speakers, said adjustable parameter being adjustable by a user.

6. The sound imaging system set forth in claim 5, wherein a listening area width will determine a selection of said 2*n* even number of four or more speakers.

7. The sound imaging system set forth in claim 6, including a first adjustment means for said user, for adjusting a number of said four or more even number of output channels by means of electrical switch selectors.

8. The sound imaging system set forth in claim 7, including second adjustment means for said user, for adjusting said adjustable parameter by means of a potentiometer.

9. The sound imaging system set forth in claim 8, wherein said adjustable parameter is adjustable within a range of 0 and 1.

10. The sound imaging system set forth in claim 9, wherein a value for said adjustable parameter is displayed.

11. The sound imaging system set forth in claim 10, wherein said four or more even number of output channels are connected respectively with said amplifiers driving said 2*n* even number of four or more speakers, each positioned in said speaker array, wherein said 2*n* even number of four or more speakers originate (4*n*−3) listener position lines within said listening area which are perpendicular to said speaker array.

12. The sound imaging system set forth in claim 11, wherein said listening area of said sound imaging system has a width extension located in between a center point of two most left speakers and a center point of two most right speakers of said speaker array.

13. The sound imaging system set forth in claim 12, wherein said speaker array is a single row speaker array.

14. The sound imaging system set forth in claim 13, wherein a multiple number of said speaker arrays installed horizontally and connected in parallel by columns, are used when the extension of the depth of said listening area requirements so demand.

* * * * *